US009883755B2

(12) United States Patent
Gonzalez et al.

(10) Patent No.: US 9,883,755 B2
(45) Date of Patent: Feb. 6, 2018

(54) SHELVING SYSTEM

(71) Applicant: SPG INTERNATIONAL LLC, Covington, GA (US)

(72) Inventors: Arturo Gonzalez, Lilburn, GA (US); Steven M. Kessell, Loganville, GA (US); Michael D. Potter, Marydel, DE (US); Jerry Vance Foster, III, Lawrenceville, GA (US)

(73) Assignee: SPG INTERNATIONAL LLC, Covington, GA (US)

( * ) Notice: Subject to any disclaimer, the term of this patent is extended or adjusted under 35 U.S.C. 154(b) by 0 days.

(21) Appl. No.: 15/675,368

(22) Filed: Aug. 11, 2017

(65) Prior Publication Data

US 2017/0340142 A1 Nov. 30, 2017

Related U.S. Application Data

(63) Continuation of application No. 15/026,519, filed as application No. PCT/US2014/058308 on Sep. 30, 2014, now Pat. No. 9,770,122.
(Continued)

(51) Int. Cl.
*A47F 5/08* (2006.01)
*A47H 1/00* (2006.01)
(Continued)

(52) U.S. Cl.
CPC ..... *A47F 5/08* (2013.01); *A47B 47/00* (2013.01); *A47B 47/022* (2013.01);
(Continued)

(58) Field of Classification Search
CPC ..... A47B 57/14; A47B 57/20; A47B 57/26; A47B 96/1433; A47B 47/00;
(Continued)

(56) References Cited

U.S. PATENT DOCUMENTS 291,030 A 1/1884 Clapper
1,424,284 A 8/1922 Dyke
(Continued)

FOREIGN PATENT DOCUMENTS

CN 1132999 10/1995
CN 101868166 A 10/2010
(Continued)

OTHER PUBLICATIONS

International Search Report and Written Opinion received in International Patent Application No. PCT/US2014/026525 dated Jul. 28, 2014 (11 pages).
(Continued)

*Primary Examiner* — Jennifer E. Novosad
(74) *Attorney, Agent, or Firm* — Michael Best & Friedrich LLP

(57) ABSTRACT

A shelving system includes a plurality of horizontal support members, each horizontal support member having a length; a plurality of wall supports, each wall support including a first surface on which at least a portion of a horizontal support member rests; a plurality of brackets, each bracket attachable to the horizontal support members at different positions along the length of the horizontal support member; a plurality of vertical support members, each vertical support member coupled to at least one bracket; and a shelf attached to at least two of the plurality of vertical support members.

18 Claims, 9 Drawing Sheets

Related U.S. Application Data

(60) Provisional application No. 61/885,480, filed on Oct. 1, 2013, provisional application No. 61/885,969, filed on Oct. 2, 2013.

(51) Int. Cl.

| | |
|---|---|
| ***A47B 43/00*** | (2006.01) |
| ***A47B 57/00*** | (2006.01) |
| ***A47B 47/00*** | (2006.01) |
| ***A47B 95/00*** | (2006.01) |
| ***A47B 57/56*** | (2006.01) |
| ***A47F 5/10*** | (2006.01) |
| ***A47B 57/30*** | (2006.01) |
| ***A47B 96/06*** | (2006.01) |
| ***A47B 57/40*** | (2006.01) |
| ***A47B 47/02*** | (2006.01) |
| ***A47B 96/02*** | (2006.01) |
| ***A47B 96/07*** | (2006.01) |
| ***A47B 57/04*** | (2006.01) |
| ***A47B 96/14*** | (2006.01) |
| ***A47B 57/48*** | (2006.01) |

(52) U.S. Cl.

CPC ..... *A47B 57/045* (2013.01); *A47B 57/30* (2013.01); *A47B 57/402* (2013.01); *A47B 57/485* (2013.01); *A47B 57/565* (2013.01); *A47B 95/008* (2013.01); *A47B 96/027* (2013.01); *A47B 96/028* (2013.01); *A47B 96/06* (2013.01); *A47B 96/061* (2013.01); *A47B 96/068* (2013.01); *A47B 96/07* (2013.01); *A47B 96/14* (2013.01); *A47B 96/1408* (2013.01); *A47F 5/0892* (2013.01); *A47F 5/103* (2013.01); *A47B 96/067* (2013.01)

(58) Field of Classification Search

CPC ... A47B 57/485; A47B 57/565; A47B 96/027; A47B 96/067; A47B 96/14; A47B 47/02; A47B 47/021; A47B 47/022; A47B 57/045; A47B 57/04; A47B 57/06; A47B 57/30; A47B 57/402; A47B 57/42; A47B 57/54; A47B 57/545; A47B 57/56; A47B 95/008; A47B 96/07; A47B 2220/0041; A47B 2220/0036; A47B 96/061; A47B 96/1408; A47B 57/028; A47B 57/45; A47F 5/08; A47F 5/13; A47F 5/0838; A47F 5/0853; A47F 5/103; A47F 5/0892

USPC .... 211/87.01, 90.01, 90.02, 90.04, 193, 103, 211/94.01, 189, 117; 248/214, 226.11, 248/227.4, 228.1, 228.6, 245, 250, 316.1, 248/242, 241, 243, 235, 247, 248, 220.42, 248/220.43

See application file for complete search history.

(56) References Cited

U.S. PATENT DOCUMENTS

| | | | | |
|---|---|---|---|---|
| 1,702,937 | A | | 2/1929 | Friedemann |
| 1,983,858 | A | | 12/1934 | Karnes |
| 2,008,180 | A | | 7/1935 | Kames |
| 2,246,090 | A | | 6/1941 | Filer |
| 2,263,282 | A | | 11/1941 | Welch et al. |
| 2,772,846 | A | | 12/1956 | Skar |
| 2,788,949 | A | | 4/1957 | Gurries |
| 2,790,559 | A | | 4/1957 | Stephenson et al. |
| 2,919,034 | A | | 12/1959 | Levy |
| 2,940,601 | A | | 6/1960 | Smith |
| 2,971,805 | A | | 2/1961 | Weiss |
| 3,057,483 | A | | 10/1962 | Derman |
| 3,097,822 | A | | 7/1963 | Attwood |
| 3,100,572 | A | | 8/1963 | Gingher et al. |
| 3,184,068 | A | | 5/1965 | Wende |
| 3,194,528 | A | | 7/1965 | Chesley |
| 3,229,823 | A | | 1/1966 | Hummer |
| 3,250,584 | A | | 5/1966 | Tassell |
| 3,273,847 | A | | 9/1966 | Berman |
| 3,294,351 | A | | 12/1966 | Rollins, Jr. |
| 3,353,684 | A | | 11/1967 | Chesley |
| 3,355,134 | A | | 11/1967 | Chesley |
| 3,358,956 | A | | 12/1967 | Thornton |
| 3,450,270 | A | | 6/1969 | Brown |
| 3,479,975 | A | | 11/1969 | Ferdinand et al. |
| 3,495,718 | A | | 2/1970 | Romero |
| 3,517,623 | A | | 6/1970 | Goldstein et al. |
| 3,561,608 | A | | 2/1971 | Weider et al. |
| 3,565,381 | A | | 2/1971 | Oliver |
| 3,572,626 | A | | 3/1971 | Bertschi |
| 3,627,247 | A | | 12/1971 | Krikorian |
| 3,631,821 | A | | 1/1972 | Zachariou |
| 3,730,108 | A | | 5/1973 | Stroh |
| 3,740,776 | A | | 6/1973 | Lazarus |
| 3,784,025 | A | | 1/1974 | Dumit |
| 3,793,655 | A | | 2/1974 | Harris et al. |
| 3,885,675 | A | | 5/1975 | Hultenby et al. |
| 3,993,002 | A | | 11/1976 | Stroh |
| 4,109,797 | A | | 8/1978 | Brunette |
| 4,116,509 | A | | 9/1978 | Smith |
| 4,122,955 | A | | 10/1978 | Celms |
| 4,146,140 | A | | 3/1979 | Suter et al. |
| 4,150,753 | A | | 4/1979 | Stahl et al. |
| 4,174,086 | A | * | 11/1979 | Verberkmoes ..... A47B 5/04 248/242 |
| 4,189,123 | A | | 2/1980 | Johnson |
| 4,190,002 | A | | 2/1980 | Redemann |
| 4,197,950 | A | | 4/1980 | Ovitz, III |
| 4,201,139 | A | | 5/1980 | Suttles |
| 4,205,815 | A | | 6/1980 | Sauer et al. |
| 4,285,436 | A | | 8/1981 | Konstant et al. |
| 4,312,086 | A | | 1/1982 | Bianco |
| 4,367,819 | A | | 1/1983 | Lewis |
| 4,397,432 | A | | 8/1983 | Resetar |
| 4,455,007 | A | | 6/1984 | Varon et al. |
| 4,534,529 | A | | 8/1985 | Dorner |
| 4,589,349 | A | | 5/1986 | Gebhardt et al. |
| 4,592,286 | A | | 6/1986 | Trubiano |
| 4,615,503 | A | | 10/1986 | Garfinkle |
| 4,623,065 | A | | 11/1986 | Cooper |
| 4,627,543 | A | | 12/1986 | Nicely |
| 4,684,094 | A | | 8/1987 | Everett |
| 4,700,916 | A | | 10/1987 | Bastian et al. |
| D311,858 | S | | 11/1990 | Richmond |
| 5,069,408 | A | | 12/1991 | Bessinger |
| 5,074,422 | A | | 12/1991 | Holtz |
| 5,080,238 | A | | 1/1992 | Hochman |
| 5,116,007 | A | | 5/1992 | Von Gunton et al. |
| 5,127,342 | A | | 7/1992 | Taylor |
| 5,161,701 | A | | 11/1992 | Berny |
| D333,059 | S | | 2/1993 | Cohn et al. |
| 5,205,630 | A | | 4/1993 | Welch |
| 5,221,014 | A | | 6/1993 | Welch et al. |
| 5,230,492 | A | | 7/1993 | Zwart et al. |
| D339,704 | S | | 9/1993 | Cohn et al. |
| 5,263,595 | A | | 11/1993 | Hilstolsky |
| 5,265,740 | A | | 11/1993 | Hodsden et al. |
| 5,288,046 | A | | 2/1994 | Eklof et al. |
| 5,303,645 | A | | 4/1994 | Meacham |
| 5,305,898 | A | | 4/1994 | Merl |
| 5,346,077 | A | | 9/1994 | Randall |
| 5,351,842 | A | | 10/1994 | Remmers |
| 5,365,860 | A | | 11/1994 | Billington, III |
| 5,390,803 | A | | 2/1995 | McAllister |
| 5,415,302 | A | | 5/1995 | Carlson et al. |
| 5,417,396 | A | | 5/1995 | Merl |
| 5,423,251 | A | | 6/1995 | Kolvites et al. |
| 5,443,167 | A | | 8/1995 | Menaged et al. |
| 5,456,435 | A | | 10/1995 | Sweeney |
| 5,472,103 | A | | 12/1995 | Merl |

(56) References Cited

U.S. PATENT DOCUMENTS

| | | | | |
|---|---|---|---|---|
| 5,477,971 | A | 12/1995 | Howard | |
| 5,509,541 | A | 4/1996 | Merl | |
| 5,518,127 | A | 5/1996 | Warmack et al. | |
| 5,531,168 | A | 7/1996 | Towfigh | |
| 5,575,444 | A | 11/1996 | Otema | |
| 5,592,886 | A * | 1/1997 | Williams | A47B 57/52 108/108 |
| 5,641,081 | A | 6/1997 | Merl | |
| 5,647,650 | A | 7/1997 | Daugherty et al. | |
| 5,655,740 | A | 8/1997 | Lazarus | |
| 5,680,942 | A | 10/1997 | McAllister et al. | |
| 5,695,163 | A | 12/1997 | Tayar | |
| 5,715,957 | A | 2/1998 | Merl | |
| 5,769,247 | A | 6/1998 | Merl | |
| 5,797,503 | A | 8/1998 | Stevens | |
| 5,806,820 | A | 9/1998 | Simon | |
| 5,816,419 | A * | 10/1998 | Lamson | A47B 57/045 211/150 |
| 5,868,263 | A | 2/1999 | McAllister et al. | |
| 5,884,567 | A | 3/1999 | Bartz, Jr. | |
| 5,915,803 | A | 6/1999 | Daugherty | |
| 5,921,190 | A | 7/1999 | Wood | |
| 5,921,411 | A | 7/1999 | Merl | |
| D415,365 | S | 10/1999 | Nicklas | |
| 5,970,887 | A | 10/1999 | Hardy | |
| 6,017,009 | A | 1/2000 | Swartz et al. | |
| 6,019,331 | A | 2/2000 | Hoogland et al. | |
| 6,116,436 | A | 9/2000 | Ferrucci et al. | |
| 6,182,937 | B1 | 2/2001 | Sanderse | |
| 6,253,687 | B1 | 7/2001 | McAllister | |
| 6,267,064 | B1 | 7/2001 | Ostertag et al. | |
| 6,345,795 | B1 | 2/2002 | Bartz, Jr. | |
| 6,431,090 | B1 | 8/2002 | Davis et al. | |
| 6,481,678 | B1 | 11/2002 | Chong | |
| 6,555,740 | B2 | 4/2003 | Roth et al. | |
| 6,625,935 | B1 | 9/2003 | King et al. | |
| 6,659,295 | B1 | 12/2003 | De Land et al. | |
| 6,726,035 | B2 | 4/2004 | Zadak | |
| 6,848,589 | B2 | 2/2005 | Wood | |
| 6,932,225 | B2 | 8/2005 | Rowe | |
| 6,935,518 | B2 | 8/2005 | Winig et al. | |
| 6,971,528 | B2 | 12/2005 | Chen | |
| 7,040,494 | B2 | 5/2006 | Harper | |
| 7,086,543 | B2 | 8/2006 | Remmers | |
| 7,128,223 | B1 | 10/2006 | Sarnoff et al. | |
| 7,147,114 | B2 | 12/2006 | Sarnoff et al. | |
| 7,150,361 | B2 | 12/2006 | Calleja | |
| 7,191,907 | B2 | 3/2007 | Conway | |
| 7,284,671 | B1 | 10/2007 | Doscher | |
| 7,311,211 | B2 | 12/2007 | Chung | |
| 7,350,649 | B1 * | 4/2008 | Martens | A47B 57/06 211/150 |
| 7,357,362 | B2 | 4/2008 | Yang et al. | |
| 7,378,213 | B2 | 5/2008 | Smalley | |
| 7,387,212 | B2 | 6/2008 | Costa et al. | |
| 7,387,213 | B1 | 6/2008 | Smalley | |
| 7,401,705 | B2 | 7/2008 | Craft | |
| 7,404,533 | B1 | 7/2008 | Kologe | |
| 7,407,060 | B2 | 8/2008 | Swartz et al. | |
| 7,494,019 | B2 * | 2/2009 | Kessell | A47B 57/06 108/108 |
| 7,497,344 | B2 | 3/2009 | Chen | |
| 7,506,772 | B2 | 3/2009 | Chen | |
| 7,568,436 | B2 | 8/2009 | McAllister et al. | |
| 7,654,497 | B1 | 2/2010 | Karan | |
| 7,677,514 | B1 | 3/2010 | Palmer | |
| 7,762,411 | B2 | 7/2010 | Hilburn et al. | |
| 7,810,438 | B2 | 10/2010 | Ryberg | |
| 7,832,571 | B2 | 11/2010 | Felsenthal | |
| 7,967,156 | B2 | 6/2011 | Hsu | |
| 7,967,268 | B2 | 6/2011 | Herron, III et al. | |
| 7,992,731 | B2 | 8/2011 | McAllister et al. | |
| 8,025,163 | B2 | 9/2011 | McAllister et al. | |
| 8,087,521 | B2 | 1/2012 | Schwartzkopf et al. | |
| 8,113,678 | B2 | 2/2012 | Babcock et al. | |
| 8,118,181 | B2 | 2/2012 | Shinozaki | |
| 8,141,724 | B2 | 2/2012 | Northam et al. | |
| 8,152,119 | B2 | 4/2012 | Pfund et al. | |
| 8,235,339 | B2 | 8/2012 | Selvidge et al. | |
| 8,424,466 | B2 | 4/2013 | Botkin | |
| 8,468,844 | B2 | 6/2013 | Nagel et al. | |
| 8,584,873 | B2 | 11/2013 | Horn et al. | |
| 8,596,590 | B2 * | 12/2013 | McCoy | F16L 3/223 211/193 |
| 8,602,372 | B2 | 12/2013 | Yu et al. | |
| 8,646,624 | B2 | 2/2014 | Fernandez et al. | |
| 9,119,471 | B2 | 9/2015 | Gonzalez et al. | |
| 9,173,506 | B2 | 11/2015 | Andersson et al. | |
| 9,770,122 | B2 * | 9/2017 | Gonzalez | A47B 96/028 |
| 2002/0104938 | A1 | 8/2002 | Simard | |
| 2004/0020885 | A1 | 2/2004 | Newman | |
| 2005/0056604 | A1 | 3/2005 | Chen | |
| 2005/0127017 | A1 | 6/2005 | Kessel et al. | |
| 2005/0145147 | A1 | 7/2005 | Costa et al. | |
| 2006/0054577 | A1 | 3/2006 | Stating et al. | |
| 2006/0091088 | A1 | 5/2006 | McCoy | |
| 2007/0110511 | A1 | 5/2007 | Chen | |
| 2007/0114348 | A1 | 5/2007 | Nawrocki | |
| 2007/0138362 | A1 | 6/2007 | McAllister et al. | |
| 2008/0083685 | A1 | 4/2008 | Chen | |
| 2008/0128373 | A1 | 6/2008 | Chang et al. | |
| 2008/0142463 | A1 | 6/2008 | Johnson | |
| 2008/0179267 | A1 | 7/2008 | Johnson | |
| 2008/0237426 | A1 | 10/2008 | Walters | |
| 2009/0014400 | A1 | 1/2009 | Nawrocki | |
| 2009/0139943 | A1 | 6/2009 | Fernandez | |
| 2010/0032394 | A1 | 2/2010 | Wang | |
| 2010/0163504 | A1 | 7/2010 | Freeman | |
| 2010/0200716 | A1 | 8/2010 | White, III | |
| 2010/0327135 | A1 | 12/2010 | Selvidge et al. | |
| 2011/0168651 | A1 | 7/2011 | Stenftenagel et al. | |
| 2011/0220602 | A1 | 9/2011 | Chen | |
| 2012/0255924 | A1 | 10/2012 | Kologe | |
| 2012/0292271 | A1 | 11/2012 | Bevelacqua | |
| 2013/0020272 | A1 | 1/2013 | Kropveld | |
| 2013/0020452 | A1 | 1/2013 | Yu et al. | |
| 2013/0021391 | A1 | 1/2013 | Rui | |
| 2015/0366339 | A1 | 12/2015 | Gonzalez et al. | |

FOREIGN PATENT DOCUMENTS

| | | |
|---|---|---|
| CN | 102131426 A | 7/2011 |
| DE | 1138902 | 10/1962 |
| DE | 9109395 | 9/1991 |
| FR | 1515478 | 3/1968 |
| GB | 1025357 | 1/1963 |
| GB | 1149568 | 6/1967 |
| GB | 2194134 | 3/1988 |
| KR | 101267731 B1 | 5/2013 |
| WO | 2005046401 | 5/2005 |

OTHER PUBLICATIONS

Extended European Search Report for Application No. 14775083.0 dated Feb. 15, 2017 (8 pages).

First Office Action and Search Report from the State Intellectual Property Office of The People's Republic of China for Application No. 201480024336.X dated Dec. 28, 2016 (16 pages).

Extended European Search Report for Application No. 14775083.0 dated Jun. 21, 2017 (9 pages).

Metro, "Metro Cantilevered Freestanding Shelving System," article (2001) 5 pages, www.metro.com.

Eagle Group, "Cantilever Shelving," article, EG7010 Rev. 3 (2005) 4 pages, www.eaglegrp.com.

Modern Equipment Company, Inc., "Meco Omaha Cantilever Rack, Buyers Guide" online brochure (2001) 12 pages.

Modern Equipment Company, Inc., "Instructions for Assembling Meco Omaha Series 2000 Medium—Heavy Duty Cantilever Rack" online brochure (2013) 6 pages, www.meco-omaha.com.

EZ Shelving Systems, Inc., "Manufacturer of Space-Saving Cantilever Shelving & Hardware," catalog (2005) pp. 1-8, Merriam, USA website: www.e-zshelving.com.

(56) References Cited

OTHER PUBLICATIONS

EZ Shelving Systems, Inc., "Manufacturer of Space-Saving Cantilever Shelving & Hardware," catalog (2008) pp. 1-4, Merriam, USA website: www.e-zshelving.com.
International Search Report and Written Opinion received in International Patent Application No. PCT/US2014/058308 dated Jan. 5, 2015 (9 pages).
First Office Action and Search Report from The State Intellectual Property Office of the People's Republic of China for Application No. 201480060558.7 dated Jun. 27, 2017 (10 pages).
Extended European Search Report for Application No. 14851078.7 dated Jun. 28, 2017 (8 pages).
U.S. Appl. No. 15/673,119, filed Aug. 9, 2017, In re Arturo Gonzalez et al., entitled "Support Bracket" (25 pages).
U.S. Appl. No. 15/678,909, filed Aug. 16, 2017, In re Arturo Gonzalez et al., entitled "Support Bracket" (23 pages).
Office Action received in U.S. Appl. No. 14/840,254, dated Sep. 29, 2017 (8 pages).
Office Action received in U.S. Appl. No. 15/673,119, dated Oct. 2, 2017 (14 pages).
Office Action received in U.S. Appl. No. 15/678,909, dated Oct. 6, 2017 (20 pages).
Second Office Action and Search Report from The State Intellectual Property Office of The People's Republic of China for Application No. 201480024336.X dated Aug. 21, 2017 (8 pages).

* cited by examiner

SHELVING SYSTEM

CROSS-REFERENCE TO RELATED APPLICATIONS

This application is a continuation of U.S. patent application Ser. No. 15/026,519 filed on Mar. 31, 2016, which is a U.S. National Phase entry of International Patent Application PCT/US14/58308 filed on Sep. 30, 2014, which claims priority to U.S. Provisional Patent Application No. 61/885,480 filed on Oct. 1, 2013, and to U.S. Provisional Patent Application No. 61/885,969 filed on Oct. 2, 2013, the entire contents of each of which are incorporated herein by reference.

FIELD

The present invention relates to shelves, racks, and workstations, and more particularly to shelves, racks, and workstations that are supported by a wall or ceiling and cantilevered for supporting items or for supporting work surfaces.

SUMMARY

An important function of most shelving and rack systems and workstations is the ability to increase storage and working space. Limitations exist in the design and assembly of many conventional shelving systems, racks and workstations. These limitations are most apparent in highly competitive industries in which space, assembly and adjustment time, and reliability are at a premium. One such industry is the food service industry, where each of these factors plays a significant role in the success and profitability of a business. Therefore, although the present invention (and the problems that exist in conventional shelving systems, racks, and workstations) is particularly well-adapted for use in the food service industry, it should be noted that the present invention is applicable to and solves similar problems in any industry employing shelving systems, racks, and workstations. Examples of such industries include retail stores in which merchandise is displayed and stored, laboratories and shops where storage and work space are needed, and warehouses in which any type of product is organized and stored.

Increased utilization of floor and storage space are primary goals for most businesses, and can significantly impact profitability of such businesses. For example, work spaces and/or storage spaces are often important resources in the food service industry, retail businesses and warehouses, to name just a few different types of businesses where space may typically be limited for such purposes. Varying the sizes and layouts of work and storage spaces calls for varying types, kinds and sizes of shelves, racks, and workstations. These structures typically consist of vertical supports, horizontal storage and support structures, and connecting elements for connecting the horizontal storage and support structures to the vertical supports, which are supported on a floor or similar surface.

It is normally desirable for shelving systems and workstations to be inexpensive, modular, adjustable, easy to assemble and disassemble, easy to clean and reliable. Conventional shelving systems and workstations do not always satisfy such criteria or provide the optimal features necessary to accomplish the goals desired. Specifically, many conventional shelving systems and workstations are often expensive, difficult to clean, assemble, disassemble, and adjust. Also, conventional systems often lack the modularity necessary to meet a wide variety of environments or prove to be unreliable.

In many conventional shelving systems and workstations, shelves are welded or otherwise permanently attached to vertical support posts, making the shelving system or workstation a single integral structure (or defining large subassemblies in such shelving systems and workstations). This makes the shelving systems and workstations more difficult to move due to the size and weight of the integral assemblies or subassemblies. Also, by permanently attaching the shelves to support posts, the shelving systems and workstations can only be arranged in a single configuration. In other conventional shelving systems and workstations, assembly can be difficult and time consuming.

In light of the problems and limitations of the prior art described above, a need exists for shelving systems and workstations that are easy to clean, are easy and quick to assemble, provide an adjustable and reliable connection between shelves and vertical support posts, can support a relatively large amount of weight, and can be supported by a wall or ceiling, thereby freeing up valuable floor space for other purposes. Each preferred embodiment of the present invention achieves one or more of these results.

In one embodiment, a shelving system is provided which includes a plurality of horizontal support members, each horizontal support member having a length; a plurality of wall supports, each wall support including a first surface on which at least a portion of a horizontal support member rests; a plurality of brackets, each bracket attachable to the horizontal support members at different positions along the length of the horizontal support member; a plurality of vertical support members, each vertical support member coupled to at least one bracket; and a shelf attached to at least two of the plurality of vertical support members.

In another embodiment, a shelving system is provided which includes a plurality of horizontal support members, each horizontal support member having a length; a plurality of wall supports, each wall support including a first surface on which at least a portion of a horizontal support member rests; a plurality of brackets, each bracket attachable to the horizontal support members at different positions along the length of the horizontal support member; a plurality of vertical support members, each vertical support member coupled to at least one bracket; a ceiling support including a second surface on which at least a portion of a horizontal support member rests, the ceiling support including an upper plate and a lower plate coupled by a least one pin, wherein the second surface is coupled to the lower plate; and a shelf attached to at least two of the plurality of vertical support members.

Various aspects of the invention will become apparent by consideration of the detailed description and accompanying drawings

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
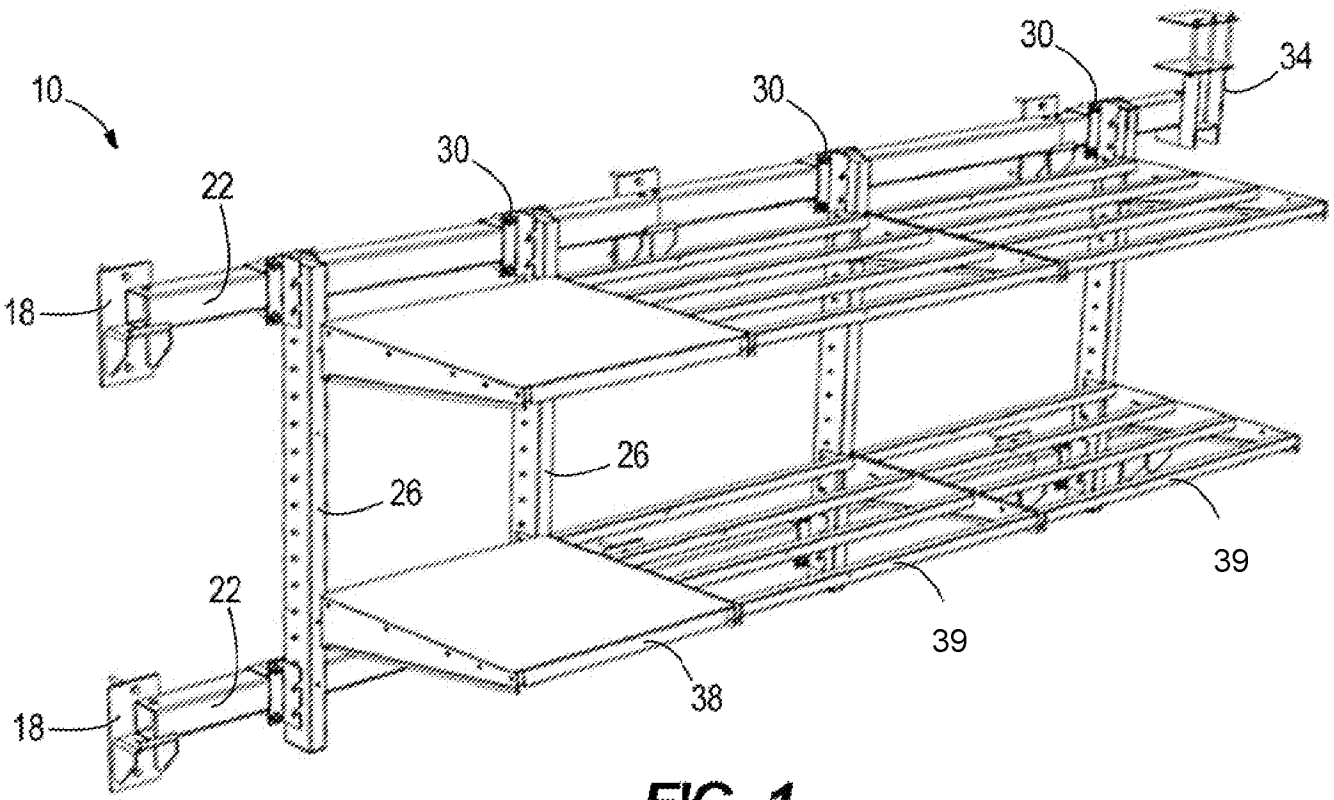
FIG. 1 is a perspective view of a shelving system.
Figure 2:
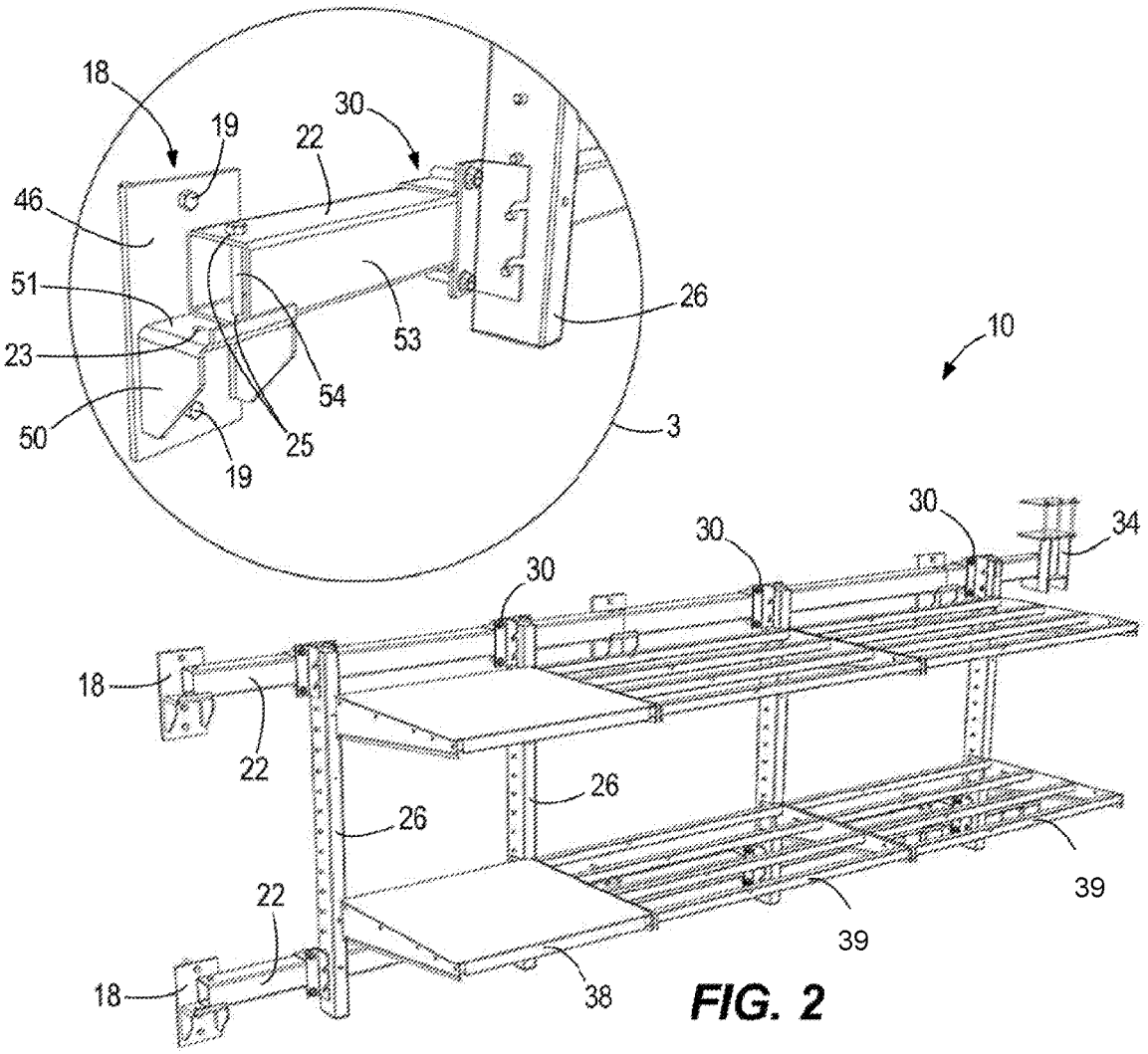
FIG. 2 includes an enlarged perspective view of a portion of the shelving system of FIG. 1.

FIGS. 1 and 2 show a shelving system 10 for supporting multiple shelves. In certain embodiments, the shelving system 10 may be positioned, for example, within a walk-in cooler or other refrigerated compartment or other types of compartments, rooms, or areas. In the illustrated embodiment, the shelving system 10 includes wall supports 18, first or horizontal support members 22, second or vertical support members 26, brackets 30, a ceiling support 34, and shelves 38. As used herein, the term "shelf" or "shelves" refers to any storage or support surface used to support product or other types of articles or upon which work can be performed.

Figure 3:
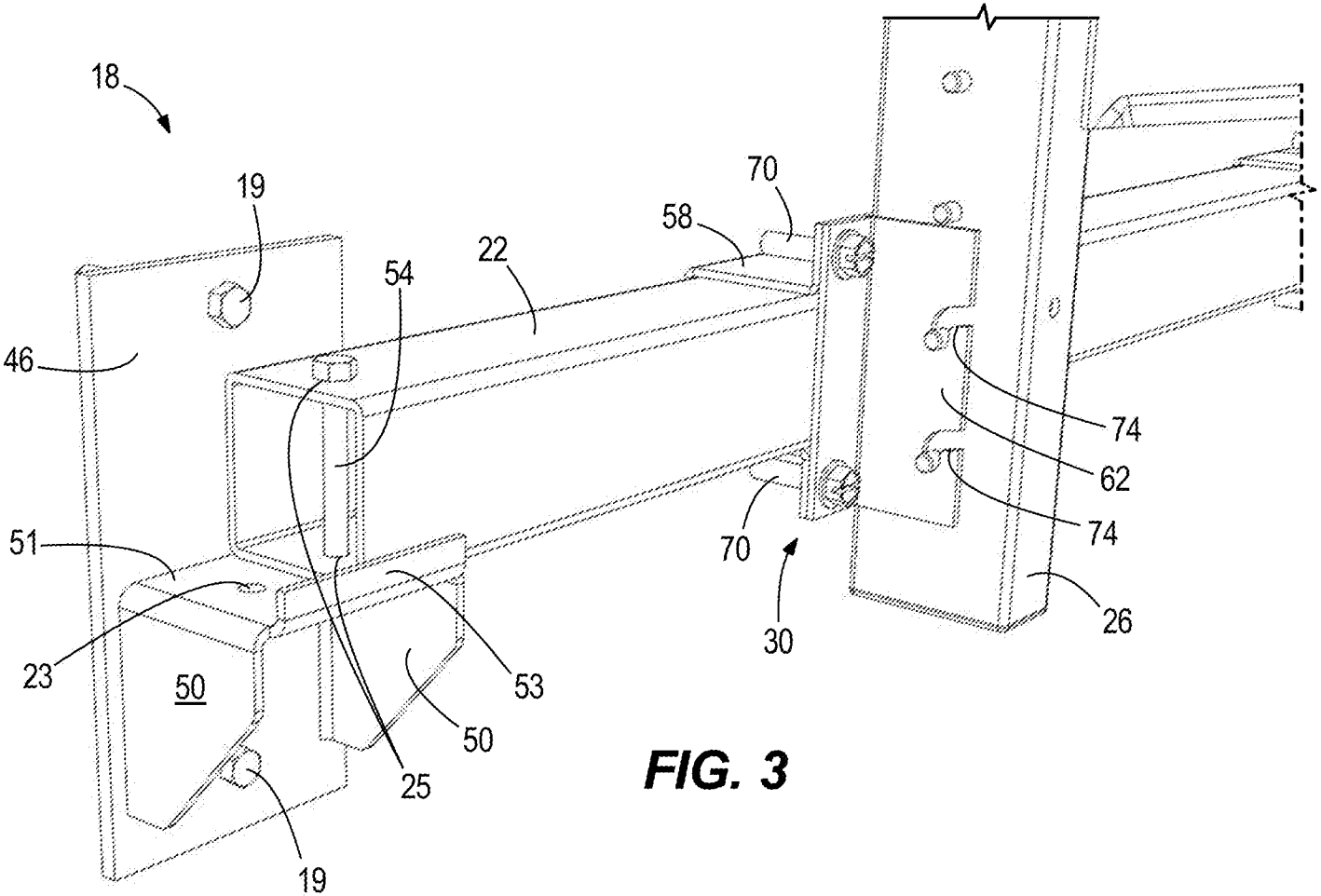
FIG. 3 is a perspective view of a wall support, a portion of a horizontal support member, a portion of a vertical support member, and a bracket.
Figure 4:
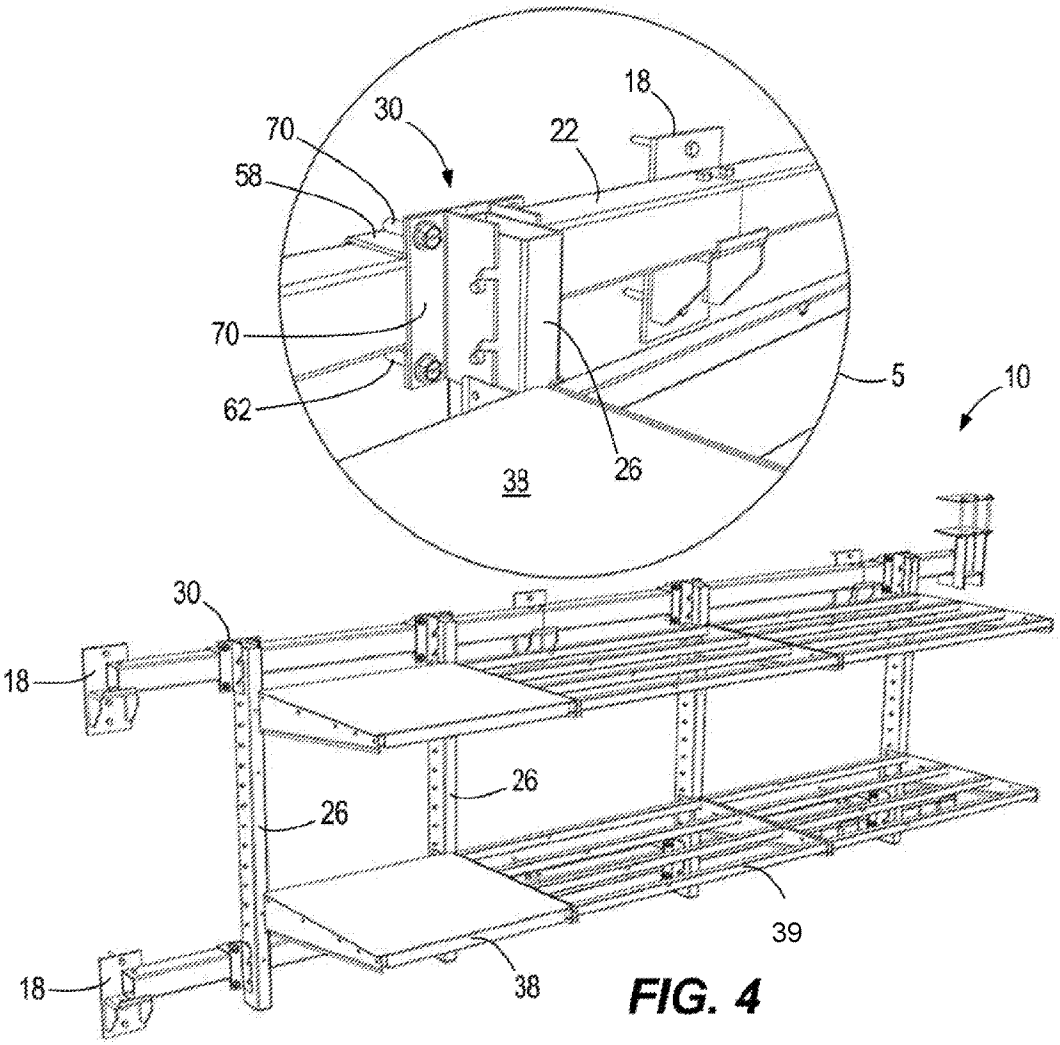
FIG. 4 includes an enlarged perspective view of a portion of the shelving system of FIG. 1.
Figure 5:
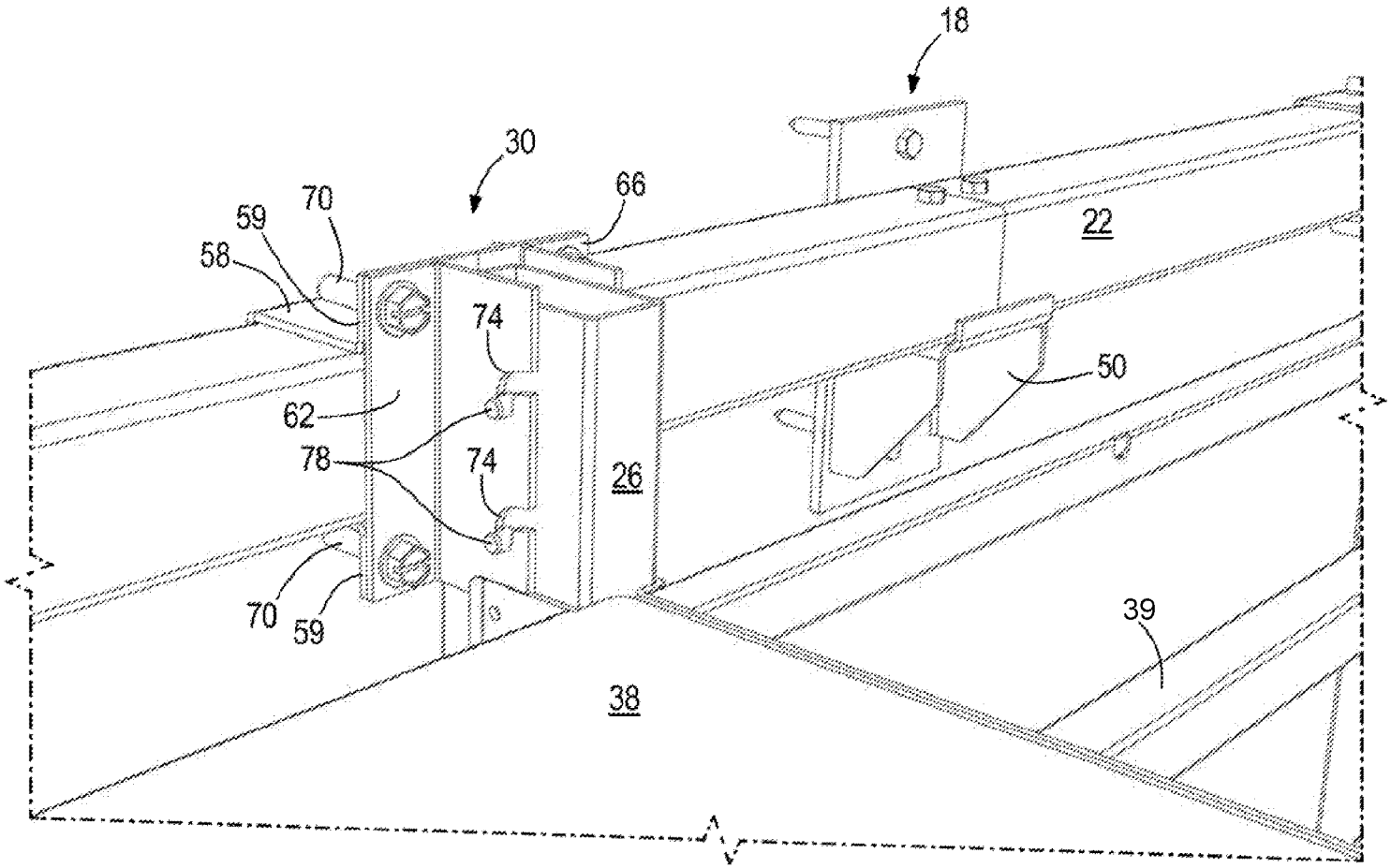
FIG. 5 is a perspective view of a portion of the horizontal support member, a bracket, a portion of a vertical support member, and a portion of a shelf.

As best shown in FIGS. 2 and 3, each of the wall supports 18 includes a plate 46 coupled to the surface of a wall (e.g., by a bolt or other fastener). Each wall support 18 includes a flange 50 extending outwardly from the plate 46. Plate 46 can be secured to a support surface such as a wall using, for example, fasteners 19 that extend through the plate and into the support surface (e.g. a wall). The flange 50 forms a surface or ledge 51 upon which the horizontal support members 22 rest. In the illustrated embodiment the ledge includes an optional lip 53 at the outer edge to securely hold the horizontal support members 22 in place on the ledge. In the illustrated embodiment, the horizontal support members 22 are fastened to the flange 50 (e.g., by a fastener such as a bolt or pin 54 extending through support member 22 and an aperture 23 that is provided in flange 50 and aligned apertures 25 that are provided in opposing upper and lower surfaces of the horizontal support member 22). In the illustrated embodiment, the horizontal support member 22 extends partially across the surface of flange 50, allowing an end of another horizontal support member 22 to be placed adjacent to the support member 22 shown in FIG. 3 and thereby to also be supported on the other portion of the surface of flange 50 as shown in FIGS. 4 and 5. Each horizontal support member 22 placed end-to-end on flange 50 is thus fastened to flange 50 by a bolt or pin 54 or other suitable fastener that extends through a flange aperture 23. Any number of horizontal support members 22 can be used to form shelving system 10 and provide a framework for vertical support members 26, as described below.

In addition, each bracket 30 is coupled to one of the horizontal support members 22. As shown in FIGS. 3-5, each bracket 30 includes a clamp 58 extending substantially around the top, rear, and bottom surfaces of horizontal support member 22, and includes a first clamping plate 62 and a second clamping plate 66 (FIG. 5). The clamp 58 includes upper and lower flanged portions 59 for coupling of the clamp 58 to the first clamping plate 62 and the second clamping plate 66 (FIG. 5). The clamp 58 is movable to different attachment positions along the horizontal support member 22 in order to accommodate different spacings for vertical support members 26, as described below. In one embodiment, the horizontal support member 22 includes detents or other marking or alignment mechanisms positioned at regular intervals (e.g., every six inches, every twelve inches, etc.) to indicate the spacing between adjacent brackets 30 and assist in positioning the vertical support members 26 relative to one another. Also, each clamping plate 62, 66 is fastened to the clamp 58 (e.g., by a pair of fasteners 70) to secure the bracket 30 to the horizontal support member 22 in a desired position along the length of the horizontal support member 22. The fasteners 70 can be loosened so that the bracket 30 can slide along the horizontal support member 22 to a desired position, where the fasteners 70 are again tightened to secure the bracket 30. Thus, it is desirable that the dimensions of clamp 58 are made such that tightening of fasteners 70 to join the clamp 58 to the first clamping plate 62 and the second clamping plate 66 causes bracket 30 to be tightened around the horizontal support member 22 to securely hold the clamp 58 in a desired position on the horizontal support member 22, whereas loosening the fasteners 70 allows the bracket 30 to slide along the horizontal support member 22. The fasteners 70 may be bolts which have matching nuts that are integrated into clamp 58 or which are separate parts from clamp 58.

The first clamping plate 62 and second clamping plate 66 may be two separate pieces, or the first clamping plate 62 and second clamping plate 66 may be part of a single piece (FIG. 9, left) which meets up with the clamp 58. The clamping plates 62, 66 are spaced apart from one another such that one of the vertical support members 26 may be positioned between the clamping plates 62, 66. When the first clamping plate 62 and second clamping plate 66 are part of a single piece, this may facilitate maintaining the correct size opening into which the vertical support member 26 fits between the first clamping plate 62 and second clamping plate 66. Each clamping plate 62, 66 includes an outwardly-extending flange 63, 67, respectively (see FIG. 9), each flange 63, 67 including multiple grooves 74 to receive pins 78 that extend outwardly from opposing sides of vertical support members 26.

In the illustrated embodiment, each vertical support member 26 is formed as a closed or box channel frame having a rectangular cross-section. In other embodiments (FIGS. 8 and 9), the vertical support member 26*b* is formed as an open or U-shaped channel. Each vertical support member 26 includes multiple pins 78 extending outward from opposing sides of the vertical support member 26. The pins 78 may extend through the vertical support member 26 or may simply project from the outer surfaces of the vertical support member 26. The ends of the pins 78 are positioned within the grooves 74 to secure the vertical support member 26 relative to the bracket 30. Thus, the bracket 30 serves to join the horizontal support members 22 to the vertical support members 26 in an adjustable manner.

Figure 8:
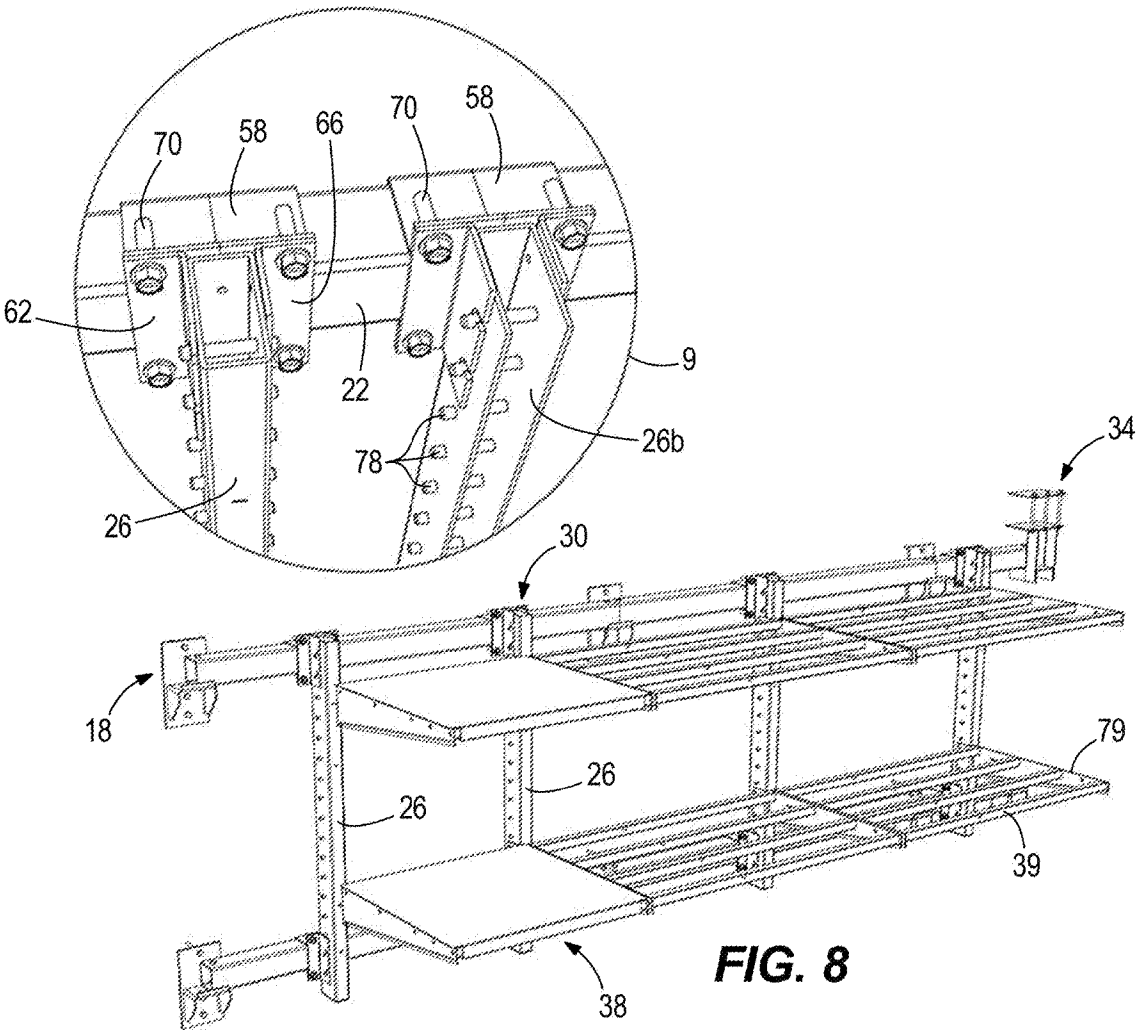
FIG. 8 includes an enlarged perspective view of a portion of the shelving system of FIG. 1.
Figure 9:
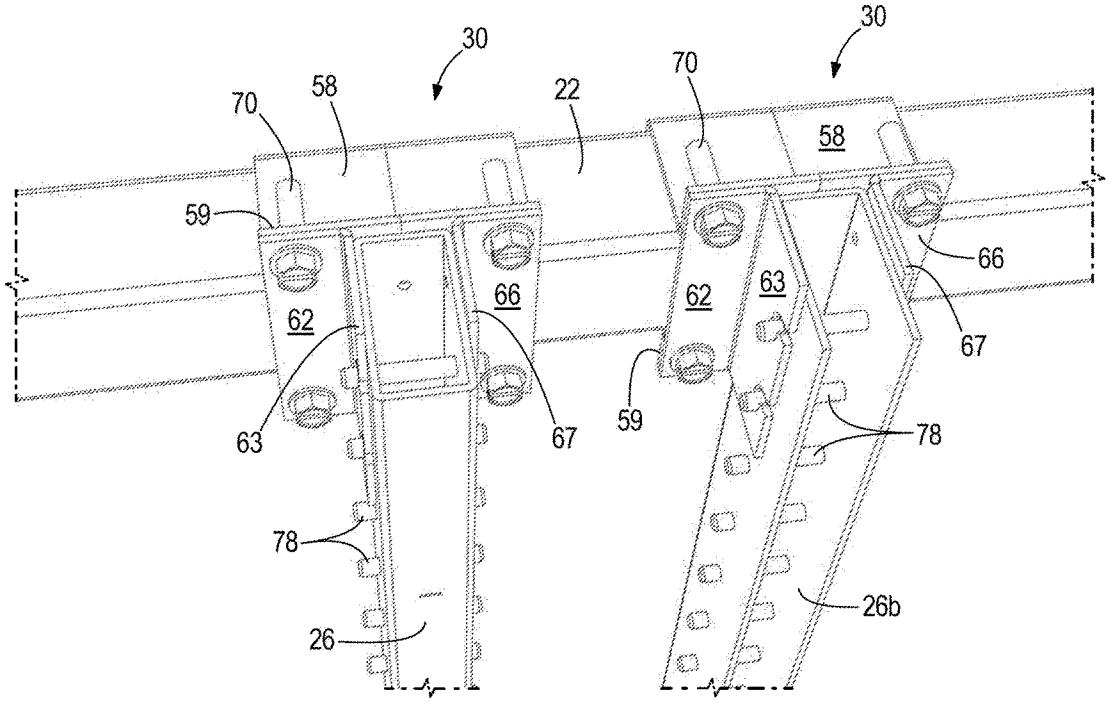
FIG. 9 illustrates a vertical support member according to one embodiments and a vertical support member according to another embodiment.

In a preferred embodiment, the pins 78 are mounted incrementally along the vertical support members 26. The pins 78 can be mounted at any regular or irregular distance from one another along any length or lengths of the vertical support member 26. However, in some preferred embodiments, the pins 78 are mounted at regular intervals along the majority of the support member's length. The pins 78 preferably extend laterally through the vertical support members 26 as shown in FIGS. 8-9. Specifically, each pin 78 is preferably a single piece that extends laterally through the support member 26 and has a portion of the pin 26 protruding laterally from both opposing sides of the member 26 (i.e., protruding from the left and right side surfaces of the support member 26 with respect to a viewing position in front of and facing the shelving system). Preferably, each pin 78 is welded to the vertical support member 26 on the left side or the right side or, more preferably, on both the left and right side. Although the pins 78 are preferably welded to both lateral sides of the support member 26, it should be noted that pins 78 extending through and past both opposing sides of the vertical support member 26 can be secured to member 26 in a number of other manners, including without limitation, by being press-fit or by otherwise having an interference fit within apertures on both opposing sides of member 26 or by being fastened to member 26 with one or more fasteners.

With reference to FIGS. 1, 2, 5, 6, and 8, the shelving system 10 preferably includes one or more shelves 38 having any size desired. In some preferred embodiments (including those shown in the figures), the shelves 38 are mounted to the vertical support members 26 by way of the support pins 78 as will be discussed below. A preferred embodiment of a shelf 38 used in shelving system 10 is illustrated in FIGS. 1, 2, 5, and 6. However, it should be noted that other shelves 38 having different sizes and shapes can employ the same features described hereafter, or shelves of different constructions may also be used in shelving system 10. In some preferred embodiments, the shelf 38 is a single integral piece having one or more cross members 39 and side braces 79. The cross members 39 preferably extend between the side braces 79 and provide a support surface for the shelf 38. Alternatively, the side braces 79 can be connected by a frame, sheet, series of bars or poles, mesh, screen, or any other element extending between the side braces 79 for purposes of supporting weight, for supporting surface covers upon which to work or store and display articles, and/or for securing the side braces 79 with respect to one another. In one embodiment, the side braces 79 may be attached to the vertical support members 26 by means of pins 78 to attach shelves 38 or like support structures or surfaces to the vertical support members 26, as described in U.S. Pat. No. 7,494,019, filed Apr. 16, 2003, the entire contents of which is incorporated herein by reference. Thus, shelves 38 may be mounted to vertical support members 26 at a desired height along the member. The side braces 79 may be separate components on which the shelves 38 are disposed, or the side braces 79 may be integrated with the shelves 38 as a single component.

Figure 6:
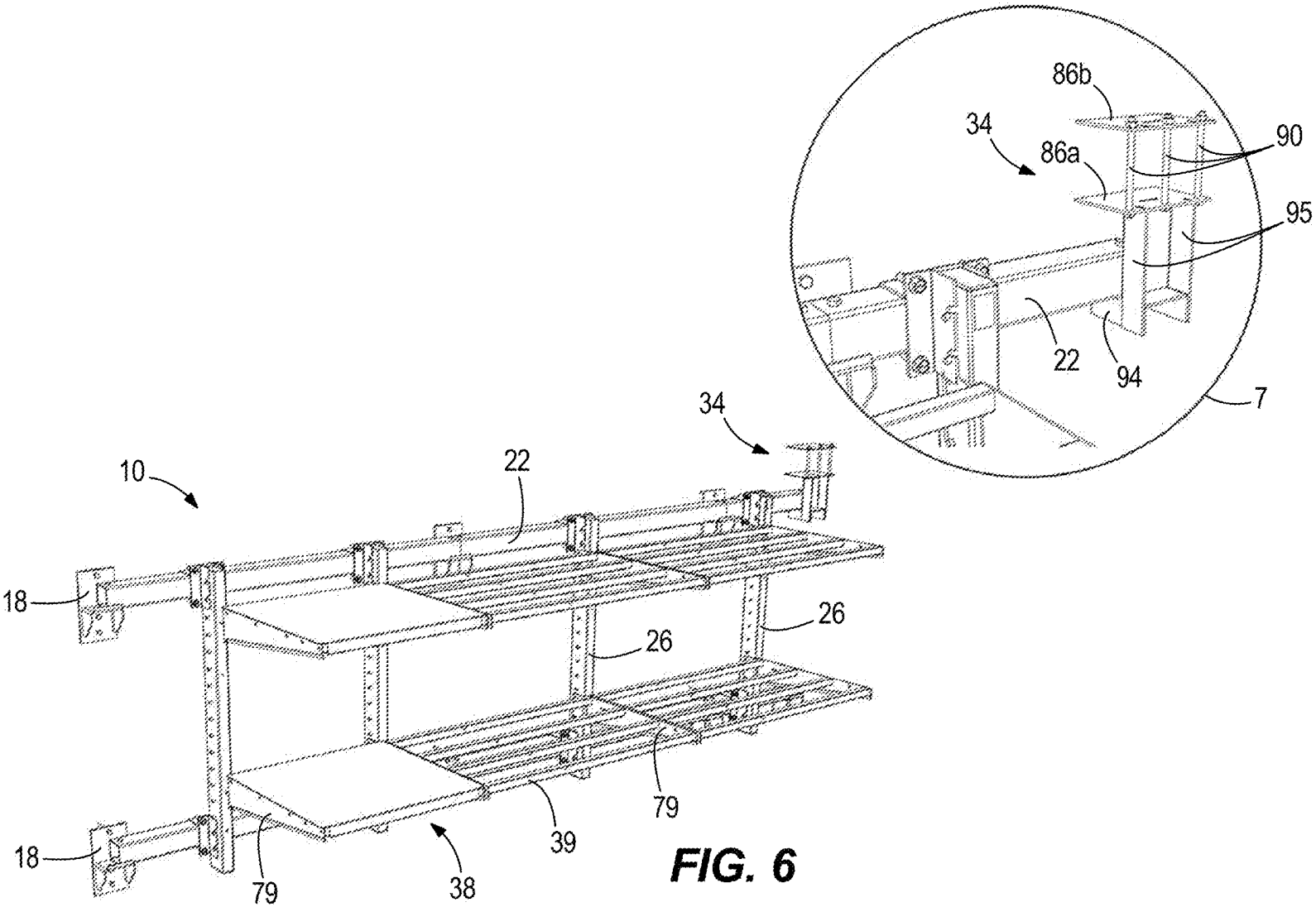
FIG. 6 includes an enlarged perspective view of a portion of the shelving system of FIG. 1.
Figure 7:
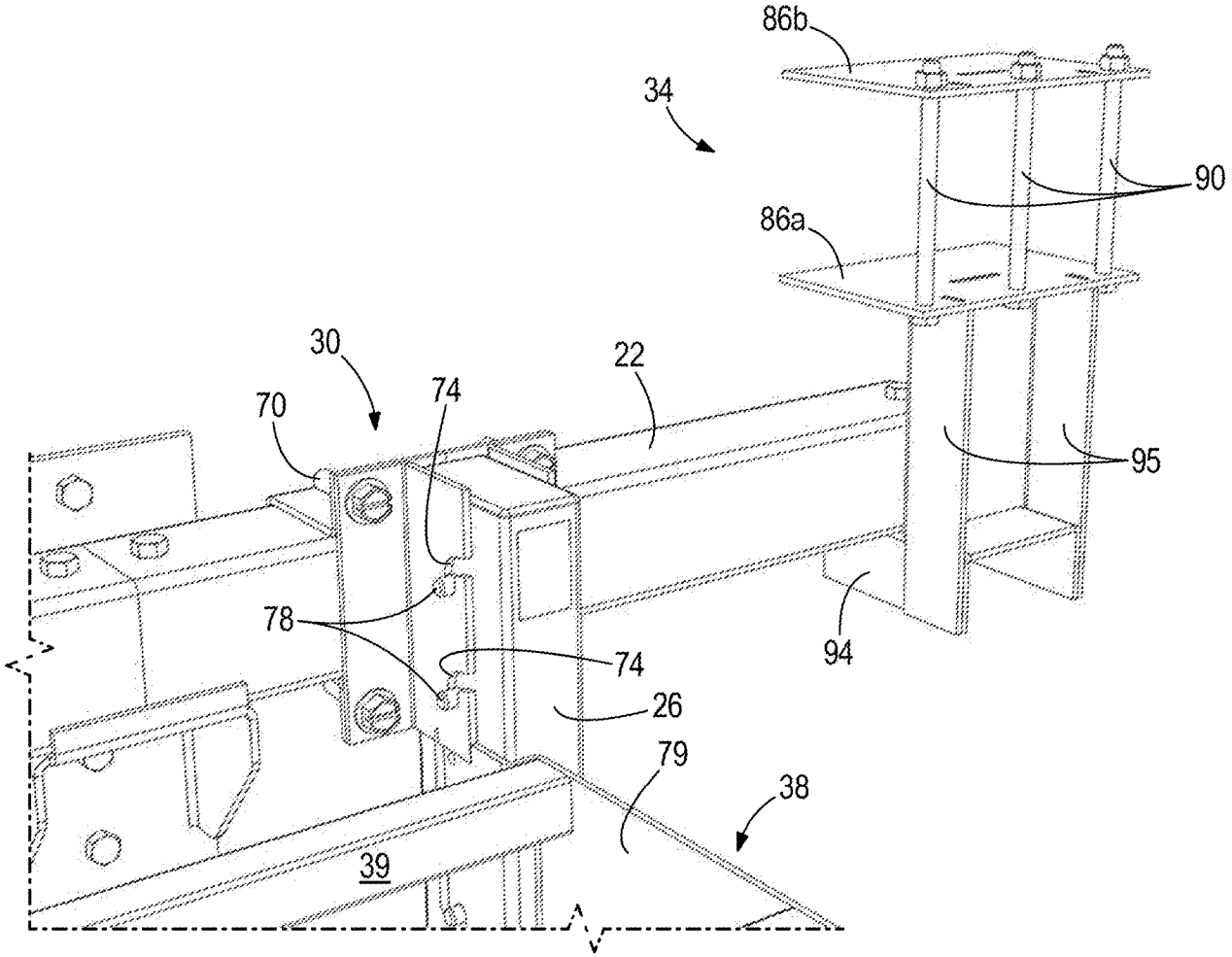
FIG. 7 is a perspective view of a portion of a shelving system including a ceiling support.

The side braces 79 may include multiple grooves, projections, or hooks (e.g. as shown and described in FIGS. 6-7 and col. 9:5-46 of U.S. Pat. No. 7,494,019, the entire contents of which is incorporated herein by reference) which engage with the pins 78. As explained above, brackets 30 can be attached to horizontal support members 22 at different positions along the horizontal support member 22 to allow a user to change the spacing between adjacent vertical supports 26 and account for variations in the width of the shelves 38. Also, the pins 78 allow for conventional shelves to be used in conjunction with the shelving system 10. Examples of such a shelving system are described in U.S. Pat. No. 7,494,019, filed Apr. 16, 2003, and U.S. Pat. No. 5,592,886, filed Jan. 31, 1994, the entire contents of both of which are incorporated herein by reference. Of course, other means of attaching shelves 38 to vertical support members 26 can be employed as known by those having ordinary skill in the art.

As shown in FIGS. 6 and 7, the ceiling support 34 is coupled to an end of one of the horizontal support members 22. The ceiling support 34 includes a pair of parallel, spaced apart horizontal plates 86*a*, 86*b*. A lower plate 86*a* is positioned adjacent an interior surface of a ceiling (not shown) of a room or compartment in which the shelving system 10 is located. An upper plate 86*a* is positioned above the ceiling of the room or compartment, adjacent an outer surface above the ceiling, thereby distributing force from the shelving system 10 over a wider area. One or multiple pins 90 extend through the space and ceiling between the plates 86*a*, 86*b*, coupling the plates 86*a*, 86*b* together. In addition, the lower plate 86*a* has attached thereto a ledge or channel 94 which is connected to the lower plate 86*a* by a pair of extensions 95. The ledge or channel 94 extends below the lower plate 86*a* and supports an end of at least one of the horizontal support members 22; one or more bolts or pins may be used to secure the horizontal support member 22 to the ledge or channel 94. The ledge or channel 94 may be located at various distances from the lower plate 86*a*, for example by providing extensions 95 of different lengths. The ceiling support 34 provides additional support and versatility for configuring shelving system 10. For example, the ceiling support 34 is useful when the shelving system 10 is mounted on a wall with a horizontal support member 22 being sufficiently close to the ceiling to allow use of the ceiling support 34, particularly in situations in which the walls of the compartment are not load-bearing, e.g. in a walk-in refrigerator or freezer. As used herein, a ceiling refers to any overhead or upper surface of a room, compartment, or area. The wall supports 18 may also help to stabilize and maintain alignment of the horizontal support members 22.

To the extent that the vertical support members 26 are supported by a wall or a ceiling of a compartment, this permits the floor to remain generally unobstructed. The load on the shelves is supported by the wall and/or ceiling in a cantilevered configuration, and the shelves 38 can be positioned above the level of the floor to permit free access to the floor space. In some embodiments, the shelving system 10 can be used alone or in conjunction with a freestanding shelving system and may also include an attachment to transfer some or all of the load to the floor. The shelving system 10 may also incorporate features of a freestanding shelving system such as those shown in U.S. Pat. No. 7,494,019, the entire contents of which is incorporated herein by reference.

By employing the wall and/or ceiling mounted horizontal members 22 to support vertical members 26, as described above, a number of embodiments of the present invention provide a workstation or a shelving or rack system that is highly adjustable, modular, and adaptable to a large number of applications, spaces, and environments, freeing up valuable floor space for other uses or purposes. In the various embodiments described above and illustrated in the figures, the use of vertical support members 26 that can be attached at a variety of desired positions along the length of horizontal support members 22, and having pins 78 extending from opposite sides thereof, enables a user to accommodate shelves 38 of different sizes and mount adjacent shelves 38 on both sides of the vertical support members 26 in a variety of configurations. Thus, once wall supports 18 and optional ceiling supports 34 have been installed, various arrangements of horizontal support members 22 and vertical support members 26 can be provided in order to accommodate a given arrangement of shelves 38. The arrangement of shelves 38 can readily be changed by rearranging the horizontal support members 22 and vertical support members 26 without having to mount any additional supports in the wall or ceiling. This versatility, coupled with the more reliable and simpler shelf mounting arrangement of the present invention, provides a number of advantages as discussed above.

Thus, the invention may provide, among other things, a shelving system. Although the invention has been described in detail with reference to certain independent embodiments, variations and modifications exist within the scope and spirit of one or more independent aspects of the invention as described. Various features and advantages of the invention are set forth in the following claims.

What is claimed is:

1. A shelving system comprising:

a shelf;

a support assembly to support the shelf comprising first and second vertical support posts, each vertical support post having a height and first and second opposed surfaces that face away from each other and a third surface that is orthogonal to and extends between the first and second opposed surfaces, and a plurality of support pins fixed to each vertical support post of the first and second vertical support posts and spaced along the height of each vertical support post and extending away from at least one of the surfaces of the first and second opposed surfaces on each vertical support post; and a pair of bracket assemblies, each bracket assembly configured such that in an assembled state of the shelving system each bracket assembly is coupled with an associated vertical support post of the first and second vertical support posts and each bracket assembly comprising a first bracket comprising a pair of spaced-apart parallel flanges, each flange formed as a planar surface, each first bracket configured such that in an assembled state of the shelving system each flange is positioned adjacent one of the surfaces of the first and second opposed surfaces of the associated vertical support post, wherein each planar surface of the pair of planar surfaces includes at least one aperture configured to releasably engage at least one selected support pin of the plurality of support pins on the associated vertical support post, each aperture formed as a slot with an open end, and a surface orthogonal to and extending between the pair of spaced-apart parallel flanges, wherein the orthogonal surface is configured such that in the assembled state of the shelving system the orthogonal surface contacts and extends across the third surface of the associated vertical support post, and second bracket configured such that in the assembled state of the shelving system the second bracket is associated with and cooperates with the first bracket to support the shelf, the second bracket being separable from the associated first bracket, the second bracket comprising a first coupling portion configured to removably couple the shelf with the associated vertical support post and a second support portion extending from the first coupling portion and configured to support the shelf, wherein the second bracket is configured such that in an assembled state of the shelving system the second bracket hinders movement of the shelf in a direction orthogonal to a plane coincident with the third surface of the associated vertical support post.

2. The shelving system of claim 1 comprising two second brackets, wherein each bracket assembly of the pair of bracket assemblies is configured such that in the assembled state of the shelving system one second bracket of the two second brackets is positioned proximate to one surface of the first and second opposed surfaces of the associated vertical support post and the other second bracket of the two second brackets is positioned proximate to the other surface of the first and second opposed surfaces of the associated vertical support post.

3. The shelving system of claim 2 comprising two shelves and wherein the support assembly is configured such that in the assembled state of the shelving system the two shelves are supported adjacent one another at the same height on the associated vertical support post by one bracket assembly of the pair of the bracket assemblies, and each second bracket of the two second brackets is positioned to support one shelf of the two shelves that are supported adjacent one another.

4. The shelving system of claim 1, wherein in the assembled state of the shelving system the first bracket of each bracket assembly of the pair of bracket assemblies is configured to couple the associated vertical support post to a support surface.

5. The shelving system of claim 1, wherein the first coupling portion and the second support portion of the second bracket are formed from a single piece of material.

6. The shelving system of claim 1, wherein the second bracket is configured such that in the assembled state of the shelving system the shelf is fixed to the second support portion of the second bracket.

7. The shelving system of claim 1, wherein each bracket assembly is configured such that in the assembled state of the shelving system a top side of the second bracket does not extend above a top side of the associated first bracket.

8. The shelving system of claim 1, wherein each bracket assembly of the pair of bracket assemblies is configured such that in the assembled state of the shelving system a top side of the shelf does not extend above a top side of each of the first brackets.

9. The shelving system of claim 1, wherein each bracket assembly of the pair of bracket assemblies is configured such that in the assembled state of the shelving system the second bracket is configured to support a bottom side of the shelf above the at least one aperture engaged with the at least one selected support pin of the plurality of support pins.

10. The shelving system of claim 1, wherein each of the planar surfaces of the first bracket includes a plurality of apertures, each aperture formed as a slot with an open end and configured to releasably engage a selected support pin of the plurality of support pins on the associated vertical support post.

11. A shelving system comprising:

a support assembly to support a shelf, wherein the support assembly has a plurality of support pins fixed to the support assembly and spaced along a height of the support assembly; and a support bracket assembly configured to be coupled to the support assembly and to the shelf, the support bracket assembly comprising a pair of first support brackets, each first support bracket comprising a pair of spaced-apart parallel planar surfaces and a third surface orthogonal to and between the spaced-apart pair of planar surfaces, each planar surface of the spaced-apart parallel planar surfaces including at least one aperture configured to releasably engage a selected support pin of the plurality of support pins, the at least one aperture formed as a slot with an open end, and a pair of second support brackets, each second support bracket of the pair of second support brackets configured such that in an assembled state of the shelving system each second support bracket is associated with and cooperates with one of the first support brackets of the pair of first support brackets to support the shelf, wherein each second support bracket is separable from the associated first support bracket, each second support bracket comprising a first coupling portion configured to removably couple the shelf to the support assembly and a second support portion extending from the first coupling portion and configured to support the shelf, and wherein the second support portion is configured such that in the assembled state of the shelving system the second support portion hinders movement of the shelf in a direction orthogonal to a plane coincident with the third surface of the associated first support bracket, and wherein the second support portion is configured such that in the assembled state of the shelving system the second support portion supports a bottom of the shelf above at least one of the selected support pins of the plurality of support pins.

12. The shelving system of claim 11, wherein the support assembly comprises a pair of vertical support posts and the plurality of support pins are fixed to and spaced along a height of each vertical support post of the pair of vertical support posts.

13. The shelving system of claim 11, wherein each second bracket of the pair of second brackets is configured such that in the assembled state of the shelving system the shelf is fixed to the second support portion of each second support bracket of the pair of second support brackets.

14. The shelving system of claim 11, wherein the support bracket assembly is configured such that in the assembled state of the shelving system a top side of each second support bracket does not extend above a top side of the associated first support bracket.

15. The shelving system of claim 11, wherein the support bracket assembly is configured such that in the assembled state of the shelving system a top side of the shelf does not extend above a top side of each of the first support brackets.

16. The shelving system of claim 11, wherein the support assembly comprises a pair of vertical support posts, each vertical support post of the pair of vertical support posts having first and second opposed surfaces that face away from each other and a third surface orthogonal to and between the opposed first and second surfaces, wherein each planar surface of the spaced-apart parallel planar surfaces of each first support bracket is configured such that in an assembled state of the shelving system each planar surface is positioned adjacent one surface of the first and second opposed surfaces of an associated vertical support post, and wherein the third surface of each of the first support brackets is configured such that in an assembled state of the shelving system the third surface contacts and extends across the third surface of the associated vertical support post.

17. The shelving system of claim 16, wherein the pair of first support brackets is configured such that in an assembled state of the shelving system the pair of support brackets couples the pair of vertical support posts to a support surface.

18. The shelving system of claim 11, wherein each planar portion of the pair of spaced-apart planar portions of each first support bracket of the pair of first support brackets includes more than one aperture, each aperture formed as a slot with an open end and configured to releasably engage a selected support pin of the plurality of support pins.

* * * * *